US008480335B1

(12) United States Patent
Hunter

(10) Patent No.: US 8,480,335 B1
(45) Date of Patent: Jul. 9, 2013

(54) ASSEMBLY FOR SUPPORTING A FOUNDATION

(76) Inventor: Steven E. Hunter, Wichita, KS (US)

( * ) Notice: Subject to any disclaimer, the term of this patent is extended or adjusted under 35 U.S.C. 154(b) by 169 days.

(21) Appl. No.: 13/090,517

(22) Filed: Apr. 20, 2011

(51) Int. Cl.
*E02D 5/00* (2006.01)

(52) U.S. Cl.
USPC ..... 405/230

(58) Field of Classification Search
USPC ..... 405/230, 229; 254/29 R; 52/741.15, 52/393, 514.5
See application file for complete search history.

(56) References Cited

U.S. PATENT DOCUMENTS 5,120,163 A * 6/1992 Holdeman et al. ..... 405/230
6,142,710 A * 11/2000 Holland et al. ..... 405/230
2002/0062622 A1* 5/2002 Bell et al. ..... 52/741.15
2008/0170912 A1* 7/2008 Kaufman ..... 405/232

* cited by examiner

*Primary Examiner* — David Bagnell
*Assistant Examiner* — Kyle Armstrong
(74) *Attorney, Agent, or Firm* — Kenneth H. Jack; Davis & Jack, L.L.C.

(57) ABSTRACT

An assembly for supporting a foundation, the assembly including a pier; the assembly further including an "E" bracket having a stem section, a plurality of suspension arms, and a buckling resisting arm, the buckling resisting arm operatively engaging the pier's upper end, and each arm among the suspension and buckling resisting arms having upper and lower ends; the assembly further including first eye and slide stop combinations attaching the upper ends of the suspension arms to the stem section; the assembly further including a weld attaching the upper end of the buckling resisting arm to the stem section; and the assembly further including a quill and foundation supporting foot bracket which is fixedly attached to the lower ends of the suspension arms.

9 Claims, 8 Drawing Sheets

ASSEMBLY FOR SUPPORTING A FOUNDATION

FIELD OF THE INVENTION

This invention relates to apparatus and assemblies which are adapted for repair or restoration of damaged building foundations, such assemblies comprising foundation supporting piers. More particularly, this invention relates to foundation jacking and leveling equipment which downwardly drive and are supported by such piers.

BACKGROUND OF THE INVENTION

Commonly known foundation lifting and leveling assemblies are adapted to perform multiple functions including facilitation of downward pier driving while utilizing a building's foundation as a driving base, and including building foundation raising and leveling through utilization of the driven piers as foundation supports. Such assemblies are commonly installed for upwardly driving against a building's foundation from a peripheral location which is slightly laterally displaced from the building's edge. The length of such lateral displacement commonly imposes an undesirable moment of torque against the pier's head or upper end, undesirably threatening to exert combined bending and buckling forces against the pier's upper end.

Imposition of such bending and buckling forces against a building foundation support pier may be catastrophic and is desirably resisted by mechanical means adapted and applied at the head of the pier. However, commonly known assemblies for pier supported jacking and leveling of foundations typically fail to present or incorporate any structure which enables the assembly to effectively resist buckling loads exerted by heavy building foundations against peripherally placed pier heads.

The instant inventive assembly for supporting a foundation solves or ameliorates the problems discussed above by incorporating and utilizing at the upper end of the assembly's pier an "E" bracket which may multiply function for foundation suspension from the head of the pier, for vertical foundation jacking with respect to the head of the pier, and for resisting bending and buckling (i.e., increasing the pier's buckle load rating) at the pier's upper end.

BRIEF SUMMARY OF THE INVENTION

A first structural component of the instant inventive assembly for supporting a foundation comprises a pier. In a preferred embodiment, the pier comprises a vertical string of pier segments, each segment being approximately 48 inches long. Each such pier segment may suitably comprise a steel pipe presenting at the inside diameter of its lower end a nesting and downwardly protruding pipe segment which serves as a coupling pin. In such embodiment, each such nesting pipe segment completes a pin and socket joint which is capable of joining with the upper opening of an immediately underlying pier segment. Where a string of such pier segments is utilized for foundation support, the segments are typically driven downwardly (through the use of a hydraulic ram) through the earth at a point immediately next to a building foundation which is in need of repair. Such hydraulic ram actuated pier driving typically continues until the segment string's lower end enters a ground stratum which is solid enough to provide needed supplementary building foundation support.

In an alternative embodiment of the instant inventive assembly, the pier component may comprise an elongated shaft of an auger. Where such pier component is utilized, the auger's shaft is initially utilized for transferring rotary torque to an auger blade at the shaft's lower end, allowing the auger blade to helically bore through the earth, drawing the shaft downwardly through the earth, preferably at a location adjacent a building foundation in need of supplementary support. Following the auger shaft's service as means for transferring rotary torque to the auger blade, the auger blade in combination with the auger shaft serves as a foundation supporting pier.

A further structural component of the instant inventive assembly comprises an "E" bracket which preferably incorporates a stem section which corresponds with a stem portion of a capitalized letter "E", a plurality of suspension arms, each corresponding with one of the arms of the "E", and a buckling force resisting arm which similarly corresponds with the third arm of the "E". For balancing of foundation loads suspended from the "E" bracket, the buckling resisting arm is preferably centrally positioned between the bracket's paired suspension arms.

In the preferred embodiment, the "E" bracket's buckling resisting arm operatively engages the upper end of the pier, such engagement preferably comprising a sleeve and shaft combination wherein the buckling resisting arm acts as stiffening sleeve which slidably receives at least a first segment, and preferably multiple segments, of the upper end of the pier. Where the pier has a hollow bore, the operative engagement of the buckling resisting arm with the pier may alternatively extend the buckling resisting arm downwardly into the pier's bore to serve therein as a stiffening stay.

The instant inventive assembly preferably further comprises first attaching means which serve to functionally interconnect the proximal or upper ends of each of the "E" bracket's arms with the "E" bracket's stem section. With respect to the buckling resisting arm, the first attaching means preferably comprises either a whole formation of the upper end of the buckling resisting arm with the "E" bracket's stem section or comprises a welded attachment.

With respect to the "E" bracket's suspension arms, the first attaching means preferably comprise a first pair of eye and slide stop combinations, such combinations' eyes opening at the "E" bracket's stem section and receiving upper ends of the suspension arms. Such combinations' pair of slide stops are preferably fixedly attached to the suspension arms' upper ends and are positioned to overlie the eyes for obstructing against the eyes' upper openings for preventing downward disengagements of the suspension arms from the stem section. Accordingly, the slide stops allow the "E" bracket's laterally paired arms to function as foundation suspending ties. In a preferred embodiment, the upper ends of the suspension arms are externally helically threaded, and the first slide stops correspondingly comprise internally helically threaded nuts which threadedly receive the extension arms' upper ends.

The instant inventive assembly preferably further comprises second attaching means which are connected operatively to the suspension arms' lower ends, the second attaching means being adapted for coupling with and for providing supplemental support to the building foundation. Suitably, the second attaching means comprise a cantilevering foundation supporting foot in combination with a sliding quill and slide shaft linkage spanning between such foot and lower ends of the suspension arms. Suitably, the foot component of such combination may be substituted with a mounting plate and anchor bolt combination which directly attaches to a side wall of a concrete foundation.

Regardless of which second attaching means configuration is utilized, the weight of the building's foundation upon the second attaching means typically applies a massive torque or twisting moment to the pier's upper end, the second attaching means acting as a lever arm in the imposition of such torque. The "E" bracket, through its incorporation and use of the centrally positioned buckling resisting arm, advantageously resists such twisting moment. Accordingly, the instant invention may prevent catastrophic buckling or inward bending of the upper end of the foundation supporting pier.

Accordingly, objects of the instant invention include the provision of an assembly for supporting a building's foundation which incorporates structural elements as described above, and which arranges those elements in relation to each in manners described above for performance and achievement of the above described functions and benefits.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
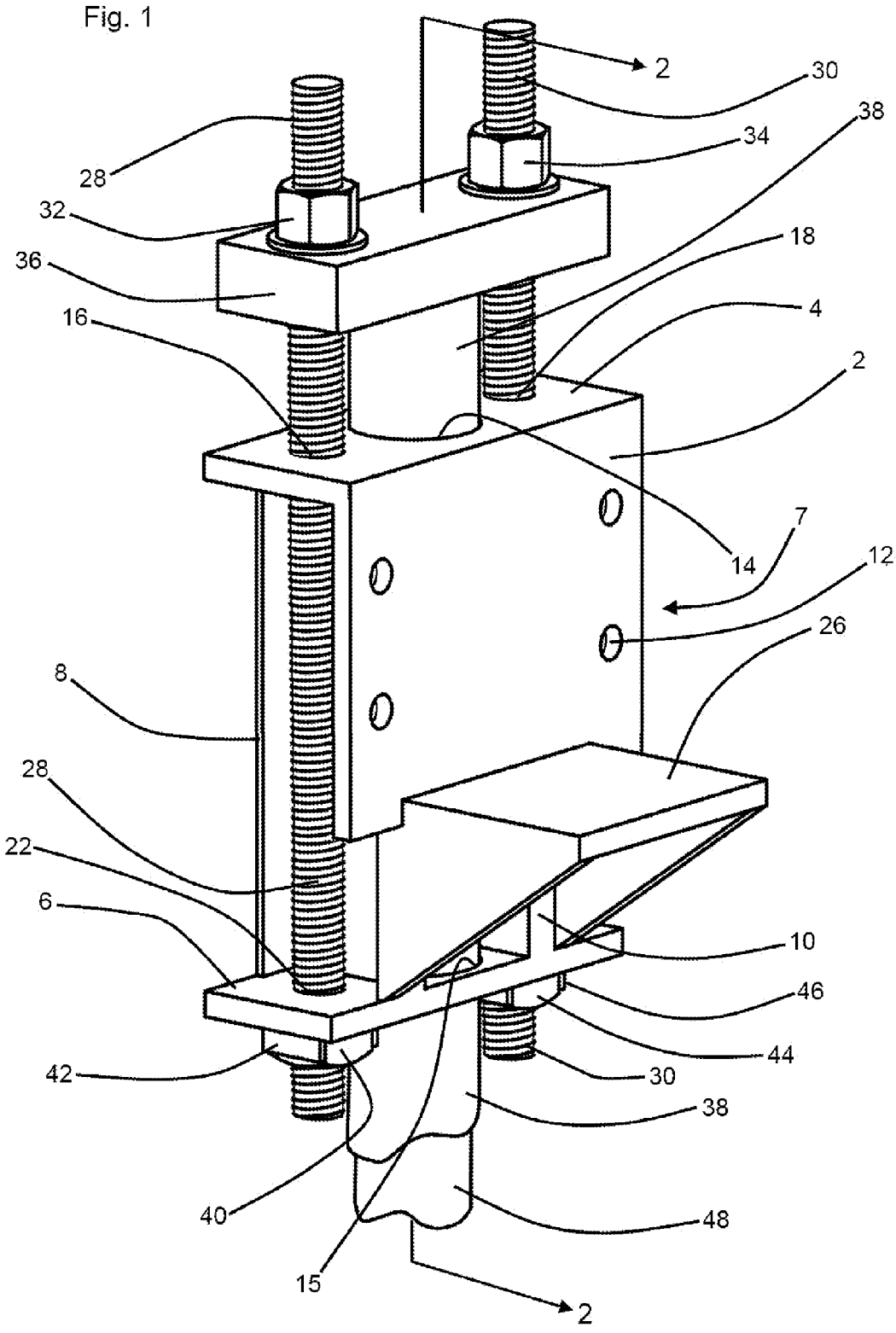
FIG. 1 is a perspective view of the instant inventive assembly for supporting a foundation.
Figure 2:
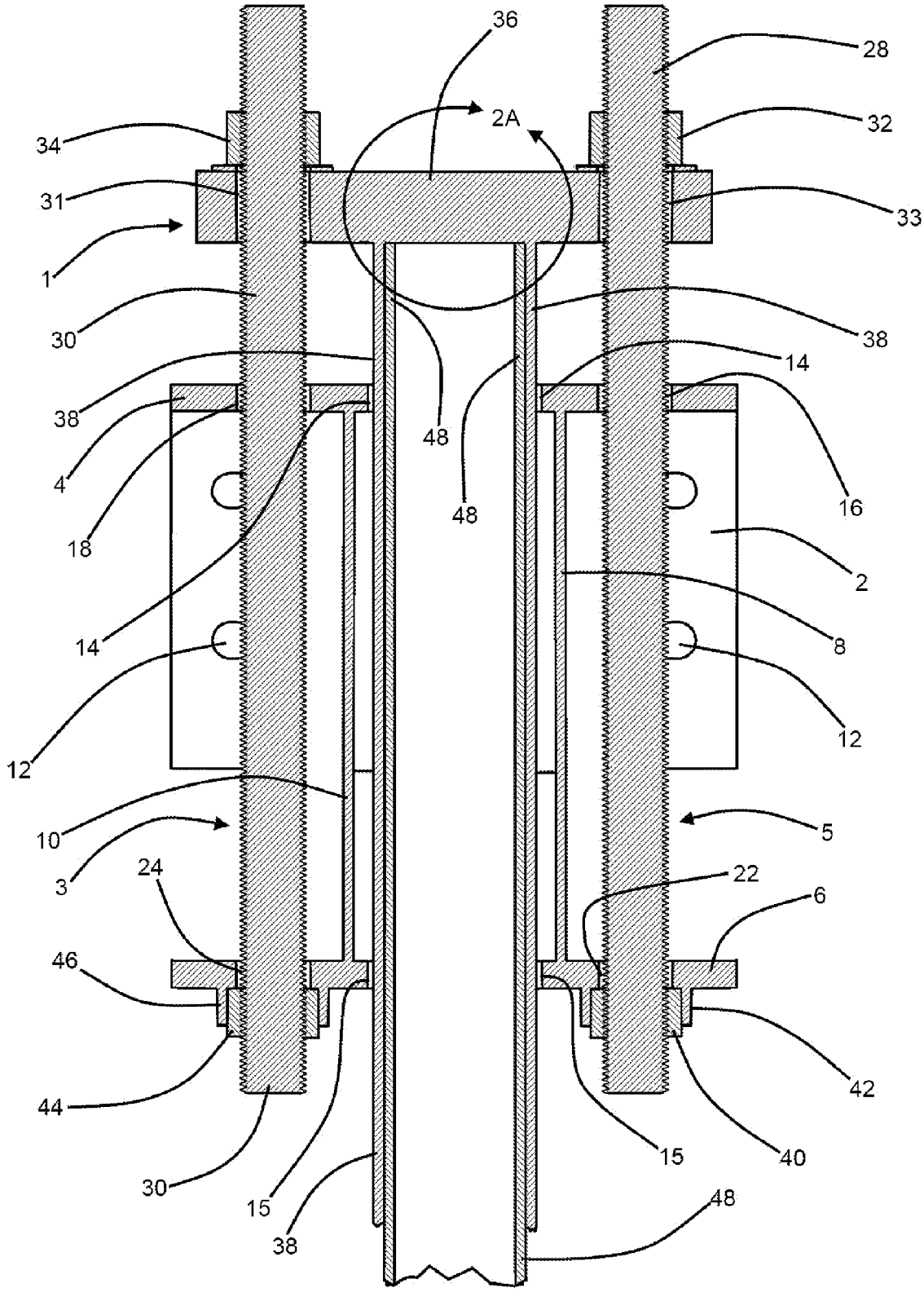
FIG. 2 is a sectional view as indicated in FIG. 1.
Figure 3:
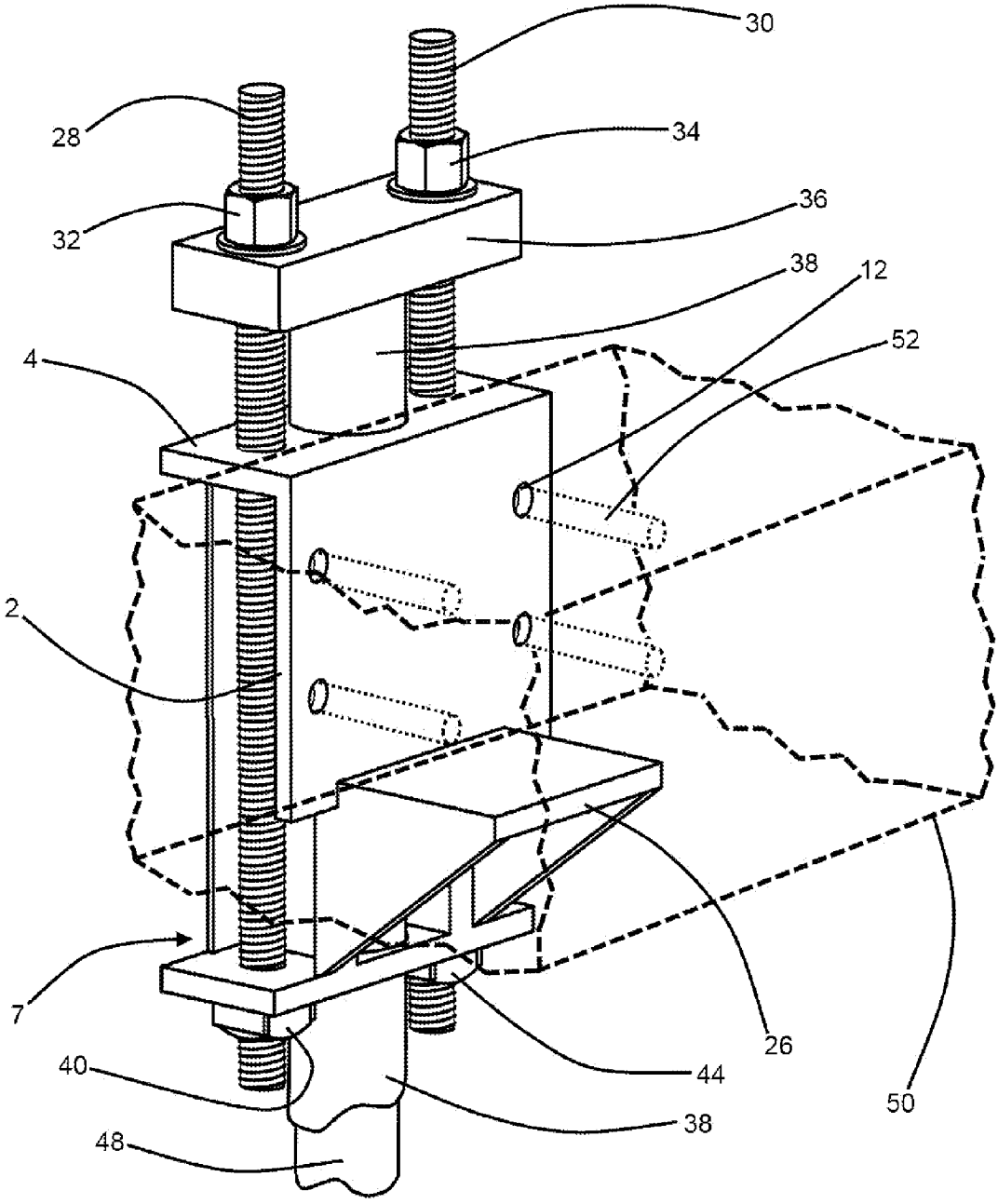
FIG. 3 redepicts FIG. 1, the view of FIG. 3 additionally showing in dashed lines a portion of a building's foundation.

Referring now to the drawings, and in particular simultaneously to FIGS. 1, 2, and 3, a first structural component of the instant inventive assembly comprises a pier 48 which is typically driven downwardly into the earth at a location adjacent the concrete foundation 50 of a building which is in need of supplemental support.

Referring further simultaneously to FIGS. 1, 2, and 3, the instant inventive assembly preferably further comprises an "E" bracket which is referred to generally by Reference Arrow 1. The "E" bracket 1 preferably comprises a heavy steel stem section 36. Arms of the "E" bracket 1 preferably comprise a plurality of, and preferably two, suspension arms which are referred to generally by Reference Arrows 3 and 5. The "E" bracket 1 preferably further comprises a medially positioned buckling resisting arm 38.

Referring further simultaneously to FIGS. 1, 2, and 3, the first attaching means are preferably provided, such means both interconnecting the upper or proximal ends of the suspension arms 3 and 5 with the stem section 36, and interconnecting the upper or proximal end of the buckling resisting arm 38 with the undersurface of the stem section 36. In a preferred embodiment, the first attaching means comprise either a whole formation or welded attachment of the upper end of the buckling resisting arm 38 to the stem section 36. The first attaching means preferably further comprise eyes 31 and 33 which open at lateral ends of the stem section 36 and a first pair or plurality of extraction stops. Where the suspension arms 3 and 5 are configured, as preferred, as externally helically threaded ties 30 and 28, the extraction stops are preferably configured as internally helically threaded nuts 34 and 32 which threadedly receive upper ends of the threaded ties 30 and 28, and which overlie eyes 31 and 33.

Referring further to FIGS. 1, 2 and 3, the suspension arms 3 and 5 may suitably alternatively comprises non-threaded steel bars, and the first attaching means may suitably comprise some other commonly known mechanical linkage or fastener such as eye and slide stopping sheer pin combinations. However, the helically threaded configuration of ties 30 and 28 is preferred because the screw heads advantageously threadedly engage with nuts 34 and 32 allowing them to dually function as extraction stops and as foundation lifting jack screw components.

Figure 2A:
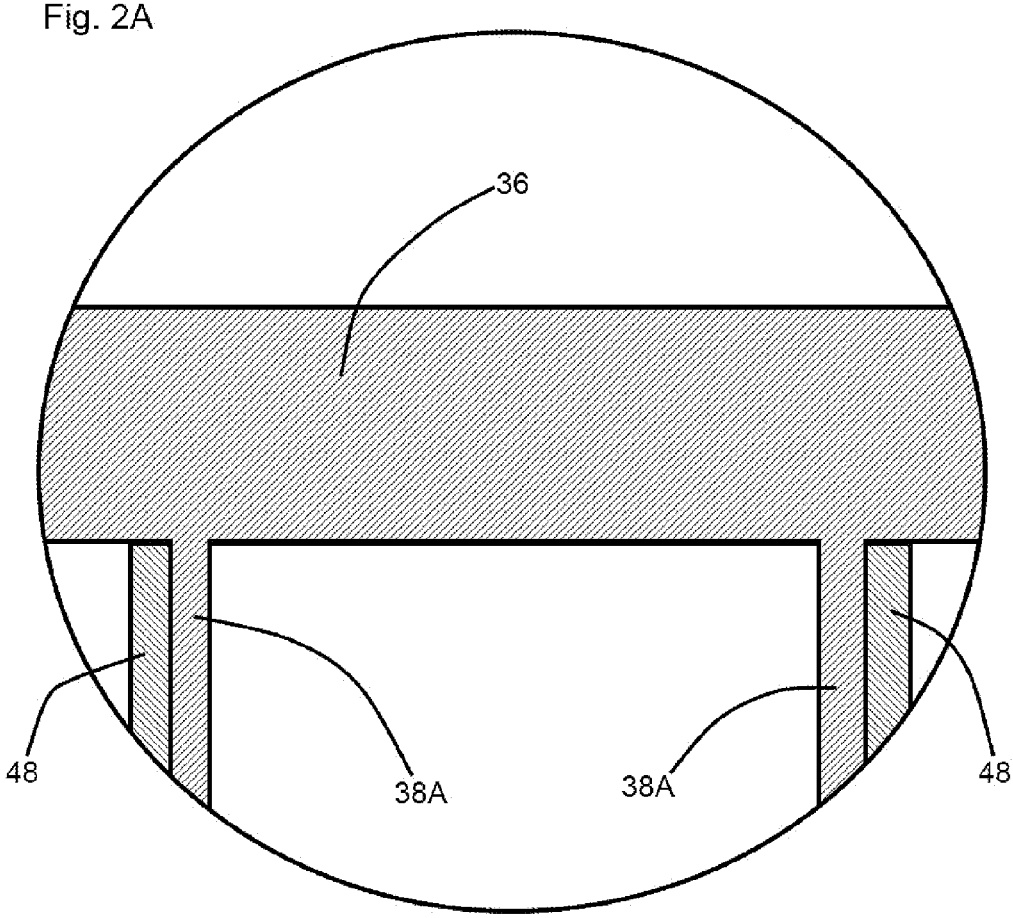
FIG. 2A presents an alternate configuration of the structure indicated in FIG. 2.

Referring further simultaneously to FIGS. 1, 2, and 3, the buckling resisting arm 38 is preferably hollow bored and is closely fitted to the outside diameter of pier 48 so that the buckling resisting arm 38 may engage the upper end of pier 48 in the manner of a stiffening sleeve. Referring to the alternative configuration of FIG. 2A, the "E" bracket's buckling resisting arm may be alternatively configured as an interior member 38A which is closely fitted to the inside diameter of the bore of the pier 48, the buckling resisting arm 38A serving in the alternative configuration as a stiffening stay.

Referring further simultaneously to FIGS. 1, 2, and 3, a further structural component of the instant inventive assembly comprises second attaching means which are referred to generally by Reference Arrow 7. The second attaching means 7 are operatively connected to the lower ends of the suspension arms 3 and 5, and such means 7 are preferably adapted for linking such suspension arms' lower ends with the building foundation 50 for supplementary foundation support.

Referring further simultaneously to FIGS. 1, 2, and 3, the second attaching means 7 are preferably configured to include a quill which defines a pier receiving slide channel, such channel preferably comprising slide ports 14 and 15 which respectively open centrally at upper plate 4 and drawing plate 6. Further preferred components of the quill configured second attaching means 7 comprise a foundation mounting plate 2 whose upper end is fixedly welded to upper plate 4 and to a pair of box framing rails 8 and 10 which are welded both to upper plate 4 and to mounting plate 2. In such second attaching means, the rails 8 and 10 extend downwardly from plate 4, to attach to the underlying drawing plate 6. The second attaching means 7 preferably further includes a plurality of anchor bolts 52 which extend through plate eyes 12 to engage foundation 50. The second attaching means may additionally or alternatively include a foundation supporting foot 26 which is fixedly welded both to rails 8 and 10 and to the lower edge of mounting plate 2.

In the preferred embodiment, the second attaching means further comprise a second plurality of slide stops which comprise nuts 40 and 44 which threadedly receive the lower ends of the externally helically threaded ties 28 and 30. Similarly with the function of the first attaching means' helically threaded nuts 32 and 34, the second attaching means' helically threaded nuts 40 and 44 advantageously function as extraction stops which immediately underlie and obstruct against the lower openings of a second pair of eyes 22 and 24 which open at drawing plate 6. Plate 4 similarly presents eyes 16 and 18 which slidably receive ties 28 and 30. Rotation stopping flanges 42 and 46 are preferably provided to assure a screw jacking capability wherein the helically threaded nuts 40 and 44 are mechanically restricted against co-rotation with the helically threaded ties 28 and 30.

Figure 4:
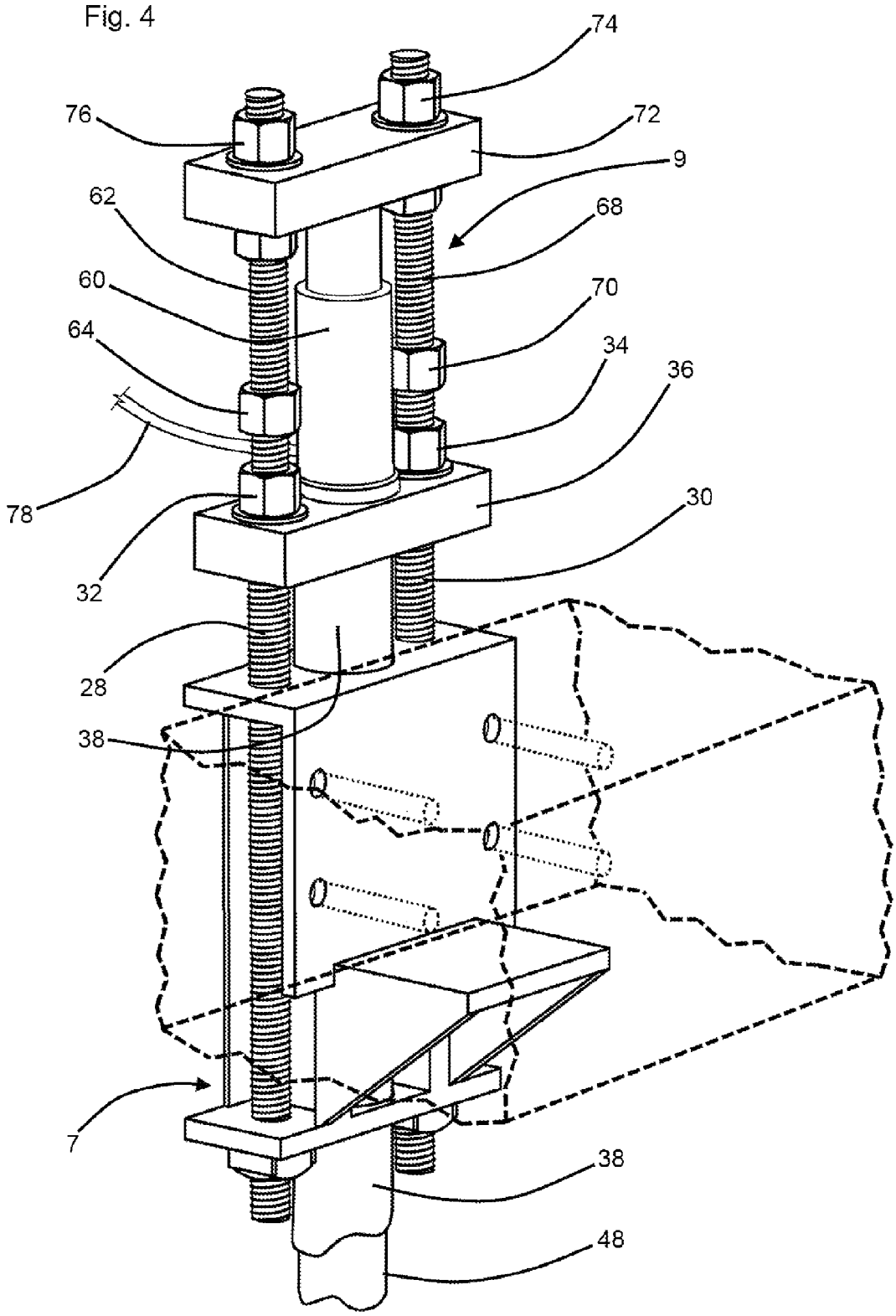
FIG. 4 redepicts FIG. 3, the view of FIG. 4 additionally showing installation of a hydraulic ram actuated foundation lifting assembly.

Referring to FIG. 4, a "U" bracket is referred to generally by Reference Arrow 9, such bracket having a cross member 72 and a pair of downwardly extending helically threaded arms 62 and 68. The upper ends of arms 62 and 68 are fixedly attached to cross member 72 by nuts 76 and 74, and the lower ends of the arms 62 and 68 are removably attached to the upwardly extending upper ends of the helically threaded ties 22 and 30 by nuts 64 and 70.

In foundation lifting use of the instant inventive assembly, referring to FIG. 4, an operator may place a one way hydraulic ram 60 served by a hydraulic pressure line 78 between the "E" bracket's stem section 36 and the "U" brackets overlying cross member 72. Thereafter, referring further simultaneously to FIG. 5, the hydraulic ram 60 may be actuated to cause its shaft 61 to telescopingly extend upwardly, carrying with it the cross member 72, the lift arms 68 and 62, the suspension ties 30 and 28, the second attaching means components including foot 26, and the building's foundation 50. Such ram driven carrying action advantageously results in an upwardly moved adjustment of the position of the foundation 50 with respect to pier 48 and with respect to the "E" bracket's buckling resisting arm 38. During such operation of the instant inventive assembly, the "E" bracket's arm 38 advantageously suspends from the stem section 36 in its buckling resisting pier engaging position. Accordingly, the "E" bracket advantageously resists buckling forces which are translated from the foundation 50 while simultaneously providing supplemental suspending support to the foundation 50.

Figure 5:
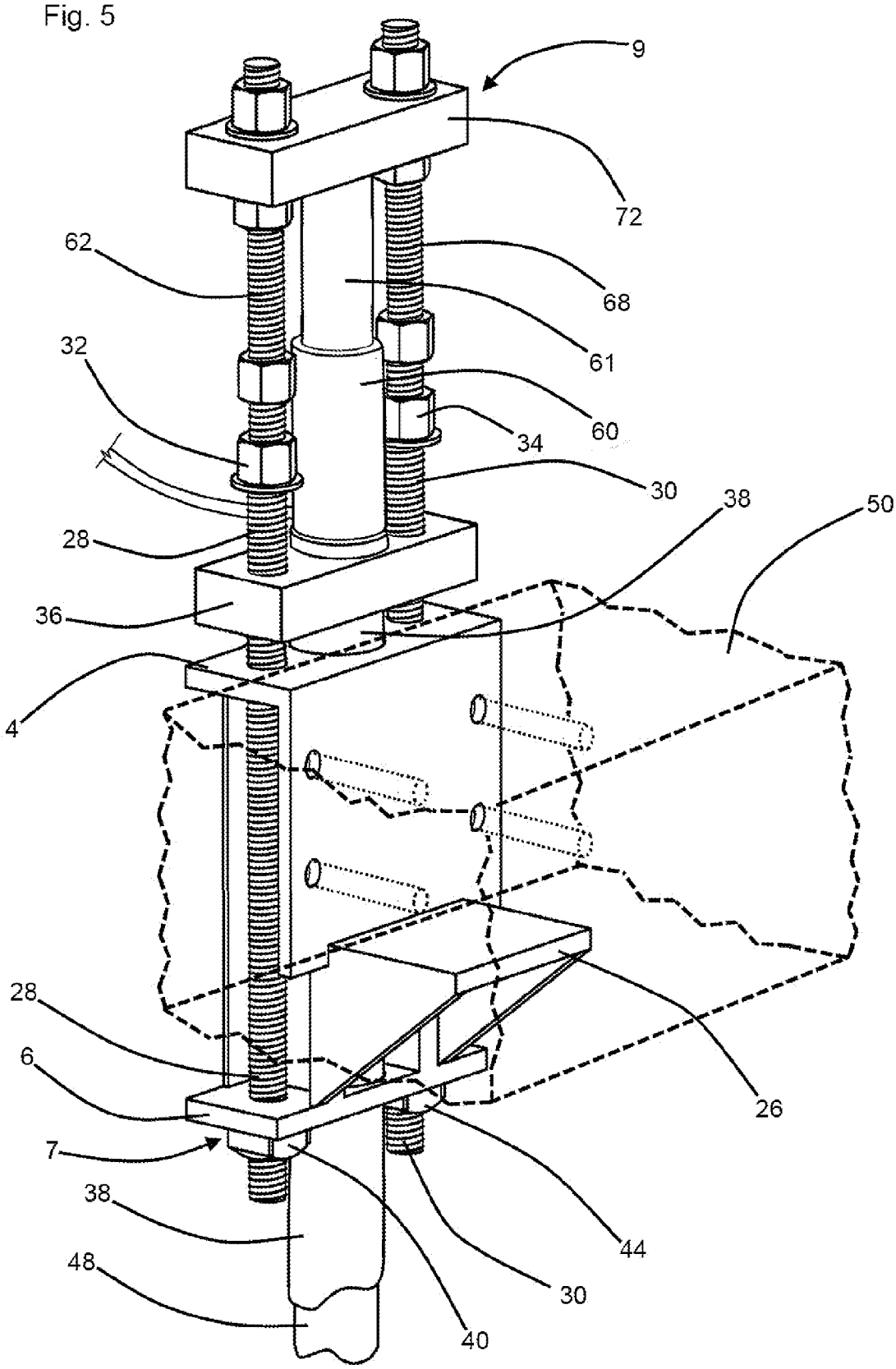
FIG. 5 redepicts FIG. 4, the view of FIG. 5 showing operation of the hydraulic ram to upwardly lift the building's foundation.
Figure 6:
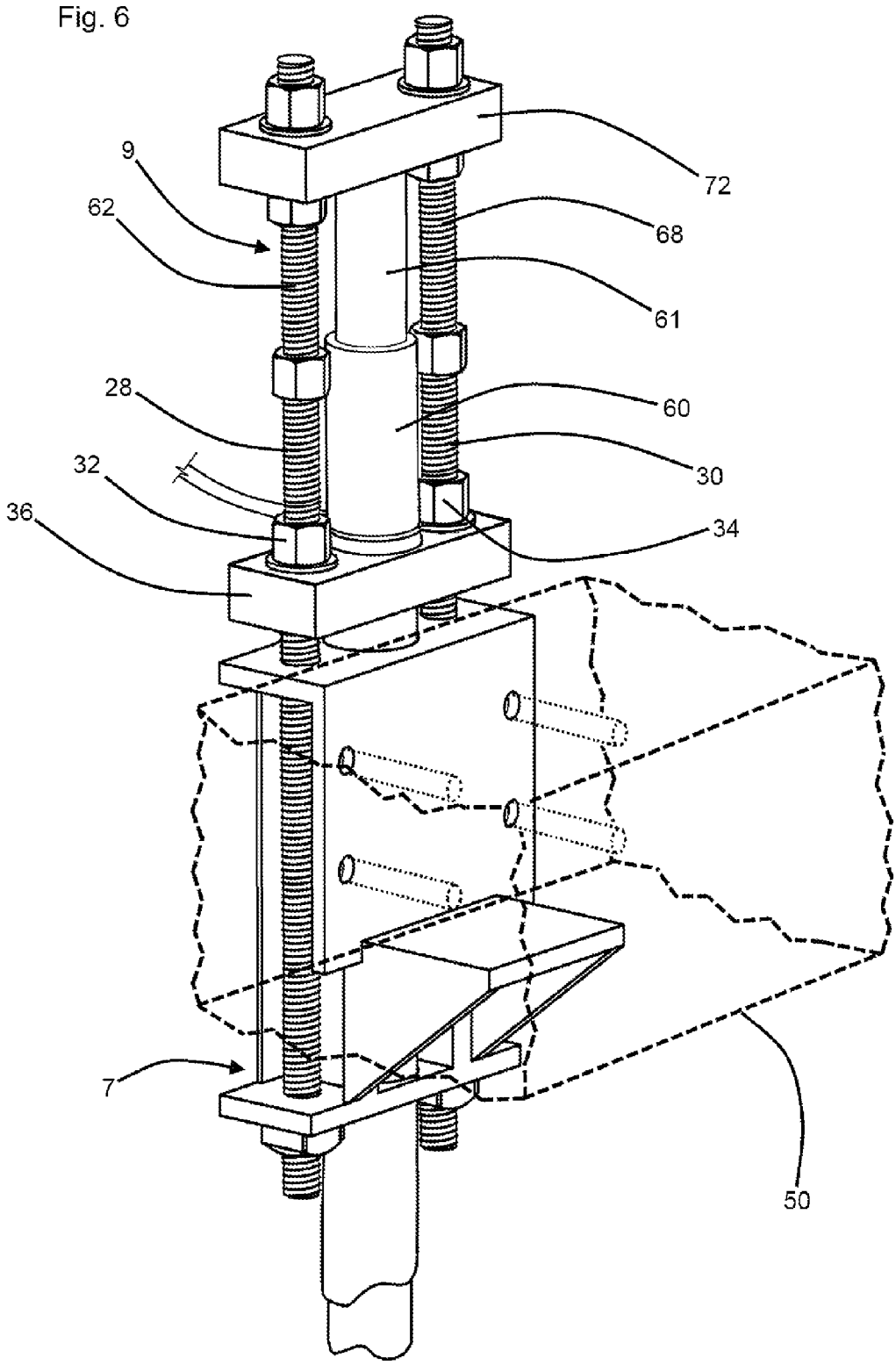
FIG. 6 redepicts FIG. 5, the view of FIG. 6 showing slide stop nuts threadedly downwardly positioned.

Referring simultaneously to FIGS. 4, 5, and 6, following utilization of the hydraulic ram 60 to raise the foundation 50 from the FIG. 4 position to the FIG. 5 position, the first plurality of stops which comprise, as preferred, nuts 32 and 34 may be turned clockwise to cause them to threadedly move from their FIG. 5 position to the lowered position depicted in FIG. 6. Upon reaching their FIG. 6 positions, nuts 32 and 34 advantageously lock the second attaching means components 7 and foundation 50 in their raised position. Thereafter, as shown in FIG. 7, the "U" bracket 9 and the hydraulic ram 60 may be removed.

Figure 7:
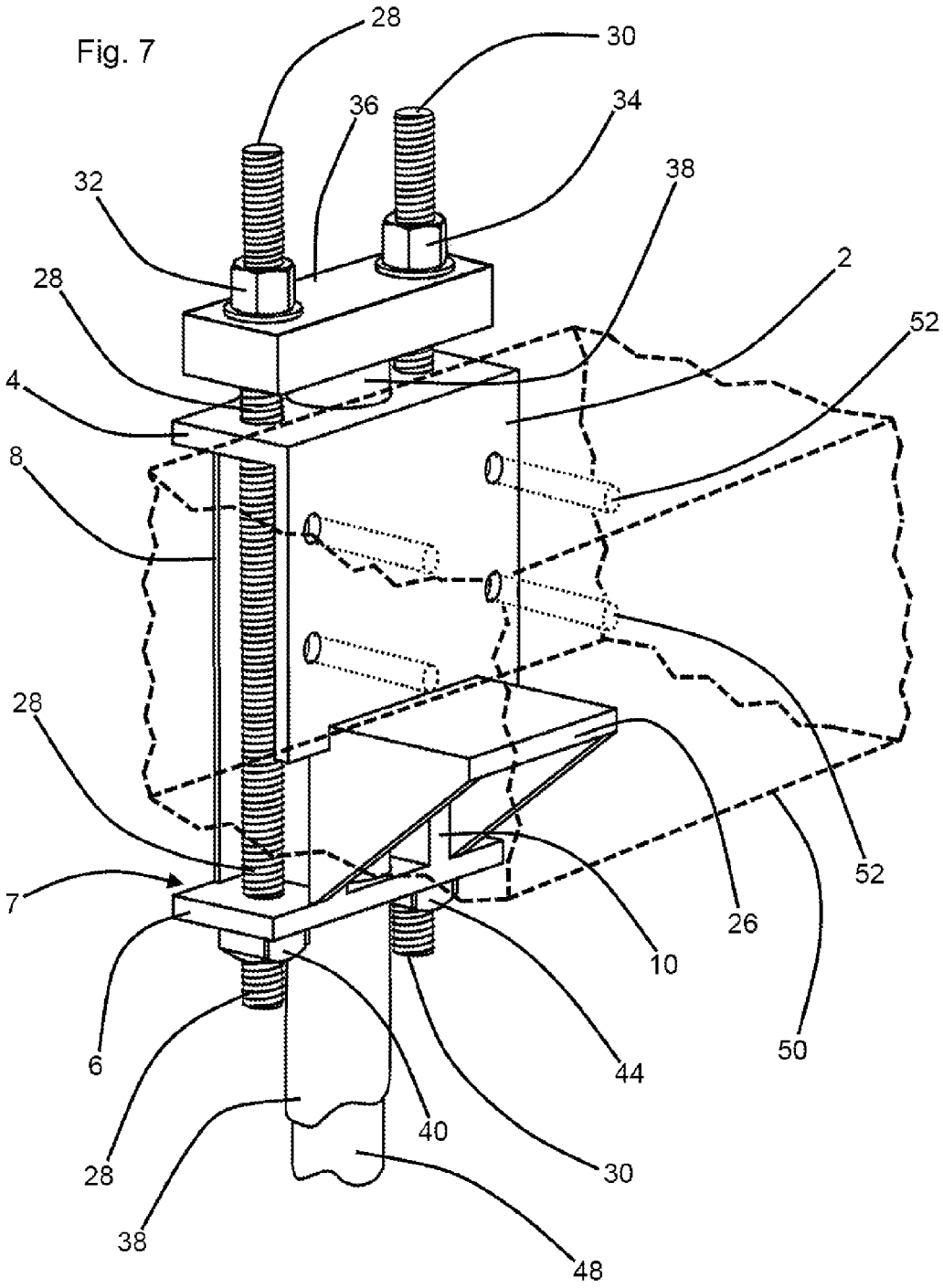
FIG. 7 redepicts FIG. 6, the view of FIG. 7 showing hydraulic ram lifting assembly removed.

Referring to FIG. 7, all components drawn other than foundation 50 are preferably composed of steel, and such components are preferably covered in a rust proof coating for prevention of corrosion. Following installation of the inventive assembly as depicted in FIG. 7, application of a wrench to nuts 32 and 34 may advantageously upwardly or downwardly adjust the position of foundation 50 with respect to the pier 48, and with respect the buckling resisting "E" bracket arm 38.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for supporting a foundation, the assembly comprising:

(a) a pier;

(b) an "E" bracket comprising a stem section, a plurality of suspension arms, and a buckling resisting arm, each arm among the suspension and buckling resisting arms having upper and lower ends, the buckling resisting arm operatively engaging the pier;

(c) first attaching means connecting the upper end of each arm among the "E" bracket's suspension and buckling resisting arms to the "E" bracket's stem section; and (d) second attaching means connected operatively to the suspension arms' lower ends, the second attaching means being adapted for linking the suspension arms' lower ends with the foundation; the buckling resisting arm comprising a stiffening member selected from the group consisting of sleeves and stays; each arm among the plurality of suspension arms comprising a tie having upper and lower ends;

the first attaching means comprising a first plurality of eyes, each eye among the first plurality of eyes opening at the "E" bracket's stem section, said each eye receiving one of the ties' upper ends; and a first plurality of stops, each stop among the first plurality of stops overlying one of the eyes among the first plurality of eyes, said each stop being fixedly attached to said each eye's received upper tie end; the second attaching means comprising a quill, the quill comprising an upper plate having an upper slide port, a drawing plate having a lower slide port, and pair of rails spanning vertically between the upper plate and the drawing plate, the quill slidably receiving the pier and the "E" bracket's buckling resisting arm, so that the pier and the buckling resisting arm extend vertically between the pair of rails and so that the pier and the buckling resisting arm extend through the upper and lower slide ports.

2. The assembly of claim 1 wherein the second attaching means further comprise a foundation engaging member selected from the group consisting of plate, eye, and anchor bolt combinations and foundation lifting feet.

3. The assembly of claim 2 wherein the drawing plate is fixedly attached to the foundation engaging member.

4. The assembly of claim 3 wherein the second attaching means further comprise a second plurality of eyes, each eye among the second plurality of eyes opening at the drawing plate, said each eye receiving one of the ties' lower ends.

5. The assembly of claim 4 wherein the second attaching means further comprise a second plurality of stops, each stop among the second plurality of stops underlying one of the eyes among the second plurality of eyes, said each stop being fixedly attached to said each eye's received lower tie end.

6. The assembly of claim 5 wherein each tie among the plurality of ties comprises a helically threaded shaft, and wherein a plurality of stops among the first and second pluralities of stops comprise helically threaded nuts, each helically threaded nut threadedly receiving one of the helically threaded shafts.

7. The assembly of claim 1 wherein the "E" bracket's buckling resisting arm is positioned between the "E" bracket's suspension arms.

8. The assembly of claim 7 wherein each suspension arm comprises an upward extension portion, each upward extension portion being adapted for attachment of a jacking assembly.

9. The assembly of claim 8 wherein each upward extension portion is externally helically threaded.

* * * * *